US005570817A

United States Patent [19]

Anderson et al.

[11] Patent Number: 5,570,817

[45] Date of Patent: Nov. 5, 1996

[54] PALM HELD PEPPER SPRAYER

[76] Inventors: John Anderson, 8337 E. Shore, Polson, Mont. 59860-9643; Paul Berman, 1133 N. Clark St., Los Angeles, Calif. 90069; Darrell Greenland, 934 Fourth St. #21, Santa Monica, Calif. 90403

[21] Appl. No.: 344,994

[22] Filed: Nov. 25, 1994

[51] Int. Cl.[6] ..... B67D 5/32

[52] U.S. Cl. ..... 222/153.11; 222/162; 222/175; 222/183; 222/402.11

[58] Field of Search ..... 222/78, 79, 153.11, 222/162, 175, 183, 402.11

[56] References Cited

U.S. PATENT DOCUMENTS

| | | | |
|---|---|---|---|
| 2,914,222 | 11/1959 | Meshberg | 222/402.11 X |
| 3,443,333 | 5/1969 | Manatos | 42/1.08 |
| 3,602,399 | 8/1971 | Litman et al. | 222/79 X |
| 3,707,794 | 1/1973 | Rocha et al. | 42/1.09 |
| 3,776,429 | 12/1973 | DeLucia | 222/162 |
| 3,841,526 | 10/1974 | Haskins | 222/79 |
| 4,316,338 | 2/1982 | Mason et al. | 222/79 X |
| 4,434,014 | 3/1984 | Meshberg | 222/402.11 X |
| 4,463,879 | 8/1984 | Des Voignes | 222/175 |
| 4,624,389 | 11/1986 | Ang | 222/78 X |
| 4,846,044 | 7/1989 | Lahr | 222/79 X |
| 5,088,121 | 2/1992 | Wallace | 224/218 X |
| 5,215,227 | 6/1993 | Farner | 222/175 |
| 5,348,193 | 9/1994 | Bruckner et al. | 222/175 |
| 5,397,029 | 3/1995 | West | 222/162 X |
| 5,458,263 | 10/1995 | Ciammitti et al. | 222/153.13 X |
| 5,484,085 | 1/1996 | Bennett | 222/183 X |

*Primary Examiner*—Kevin P. Shaver

[57] ABSTRACT

A sprayer for dispensing a chemical repellant. The inventive device includes a main body positionable within the palm of a hand. A nozzle conduit projects from a medial portion of the main body to extend between two fingers of the hand. A dispensing assembly within the main body permits selective dispensing of a chemical repellant through the nozzle conduit to repel an attacker.

10 Claims, 4 Drawing Sheets

PALM HELD PEPPER SPRAYER

BACKGROUND OF THE INVENTION

1. Field of the Invention

The present invention relates to self defense devices and more particularly pertains to palm held pepper sprayer for dispensing a chemical repellant to repel an attacker.

2. Description of the Prior Art

The use of self defense devices is known in the prior art. More specifically, self defense devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art self defense devices include U.S. Pat. No. 4,241,850; U.S. Pat. No. 4,316,338; U.S. Pat. No. 5,088,121; U.S. Pat. No. 4,846,044; U.S. Pat. No. 4,624,389; U.S. Pat. No. 3,707,794 and U.S. Pat. No. 3,443,333.

While these devices fulfill their respective, particular objectives and requirements, the aforementioned patents do not disclose a palm held pepper sprayer for dispensing a chemical repellant which includes a main body positionable within the palm of a hand, a nozzle conduit projecting from a medial portion of the main body so as to extend between two fingers of the hand, and a dispensing assembly within the main body for permitting selective dispensing of a chemical repellant through the nozzle conduit to repel an attacker.

In these respects, the palm held pepper sprayer according to the present invention substantially departs from the conventional concepts and designs of the prior art, and in doing so provides an apparatus primarily developed for the purpose of dispensing a chemical repellant.

SUMMARY OF THE INVENTION

In view of the foregoing disadvantages inherent in the known types of self defense devices now present in the prior art, the present invention provides a new palm held pepper sprayer construction wherein the same can be utilized for dispensing a chemical repellant. As such, the general purpose of the present invention, which will be described subsequently in greater detail, is to provide a new palm held pepper sprayer apparatus and method which has many of the advantages of the self defense devices mentioned heretofore and many novel features that result in a palm held pepper sprayer which is not anticipated, rendered obvious, suggested, or even implied by any of the prior art self defense devices, either alone or in any combination thereof.

To attain this, the present invention generally comprises a sprayer for dispensing a chemical repellant. The inventive device includes a main body positionable within the palm of a hand. A nozzle conduit projects from a medial portion of the main body to extend between two fingers of the hand. A dispensing assembly within the main body permits selective dispensing of a chemical repellant through the nozzle conduit to repel an attacker.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new palm held pepper sprayer apparatus and method which has many of the advantages of the self defense devices mentioned heretofore and many novel features that result in a palm held pepper sprayer which is not anticipated, rendered obvious, suggested, or even implied by any of the prior art self defense devices, either alone or in any combination thereof.

It is another object of the present invention to provide a new palm held pepper sprayer which may be easily and efficiently manufactured and marketed.

It is a further object of the present invention to provide a new palm held pepper sprayer which is of a durable and reliable construction.

An even further object of the present invention is to provide a new palm held pepper sprayer which is susceptible of a low cost of manufacture with regard to both materials and labor, and which accordingly is then susceptible of low prices of sale to the consuming public, thereby making such palm held pepper sprayers economically available to the buying public.

Still yet another object of the present invention is to provide a new palm held pepper sprayer which provides in the apparatuses and methods of the prior art some of the advantages thereof, while simultaneously overcoming some of the disadvantages normally associated therewith.

Still another object of the present invention is to provide a new palm held pepper sprayer for dispensing a chemical repellant from between two fingers of a hand.

Yet another object of the present invention is to provide a new palm held pepper sprayer which includes a main body positionable within the palm of a hand, a nozzle conduit projecting from a medial portion of the main body to extend between two fingers of the hand, and a dispensing assembly within the main body for permitting selective dispensing of a chemical repellant through the nozzle conduit to repel an attacker.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
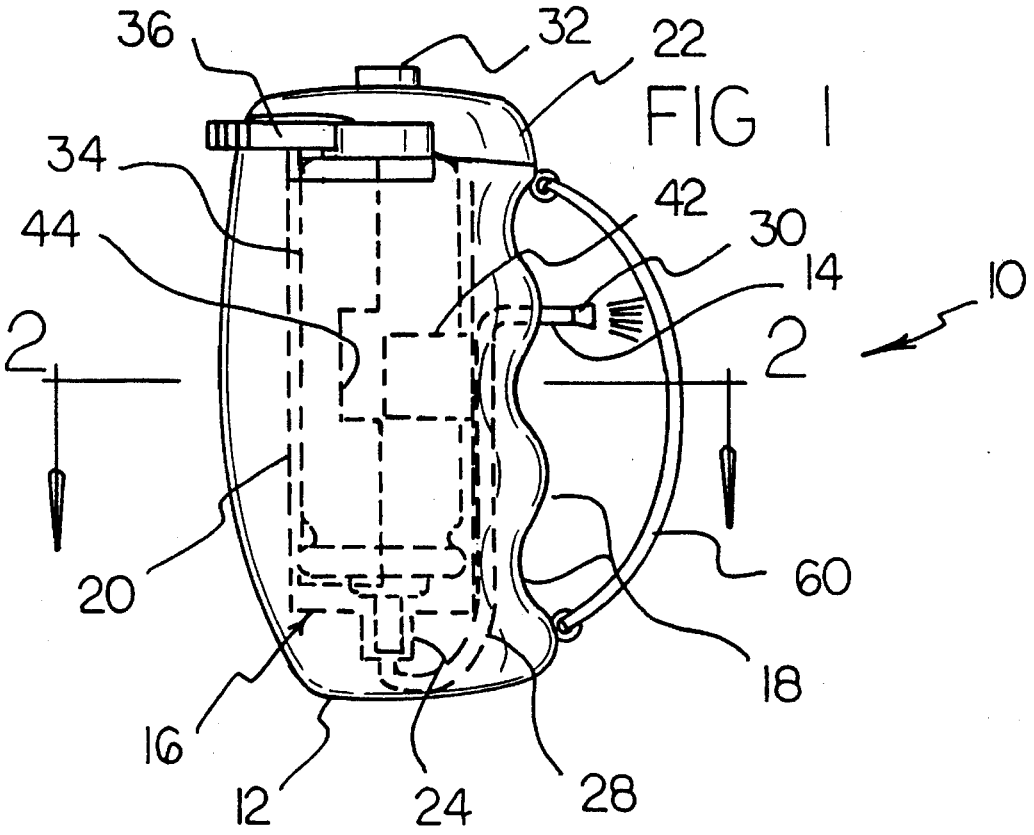
FIG. 1 is a side elevation view of a palm held pepper sprayer according to the present invention.

With reference now to the drawings, and in particular to FIGS. 1–6 thereof, a new palm held pepper sprayer embodying the principles and concepts of the present invention and generally designated by the reference numeral 10 will be described.

More specifically, it will be noted that the palm held pepper sprayer 10 comprises a main body 12 for positioning across a palm of a hand. A nozzle conduit 14 extends from a medial portion of the main body 12 to be positioned between two adjacent fingers of the hand. A dispensing means 16 is positioned within the main body 12 for dispensing a chemical repellant through the nozzle conduit 14 to repel an attacker.

Figure 2:
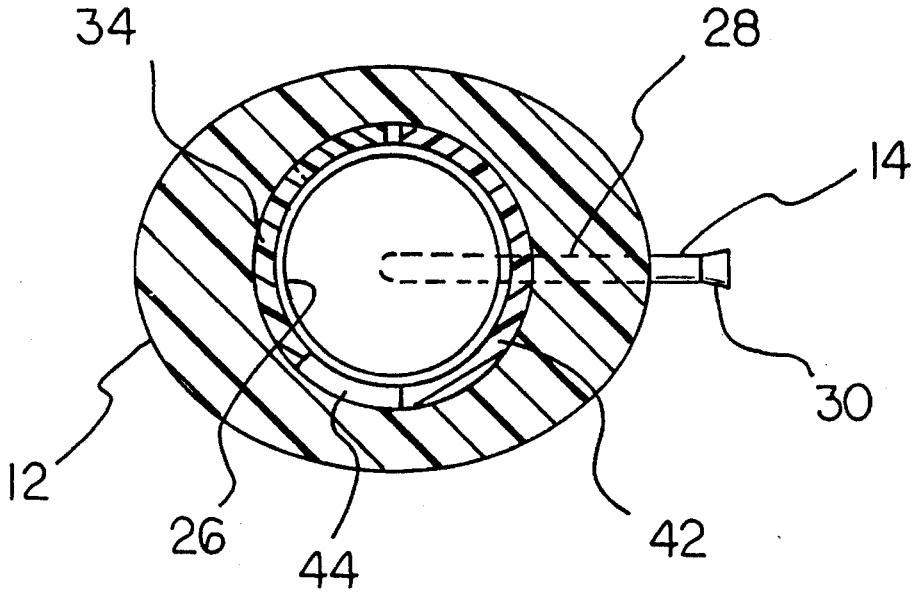
FIG. 2 is a cross sectional view taken along line 2—2 of FIG. 1.
Figure 3:
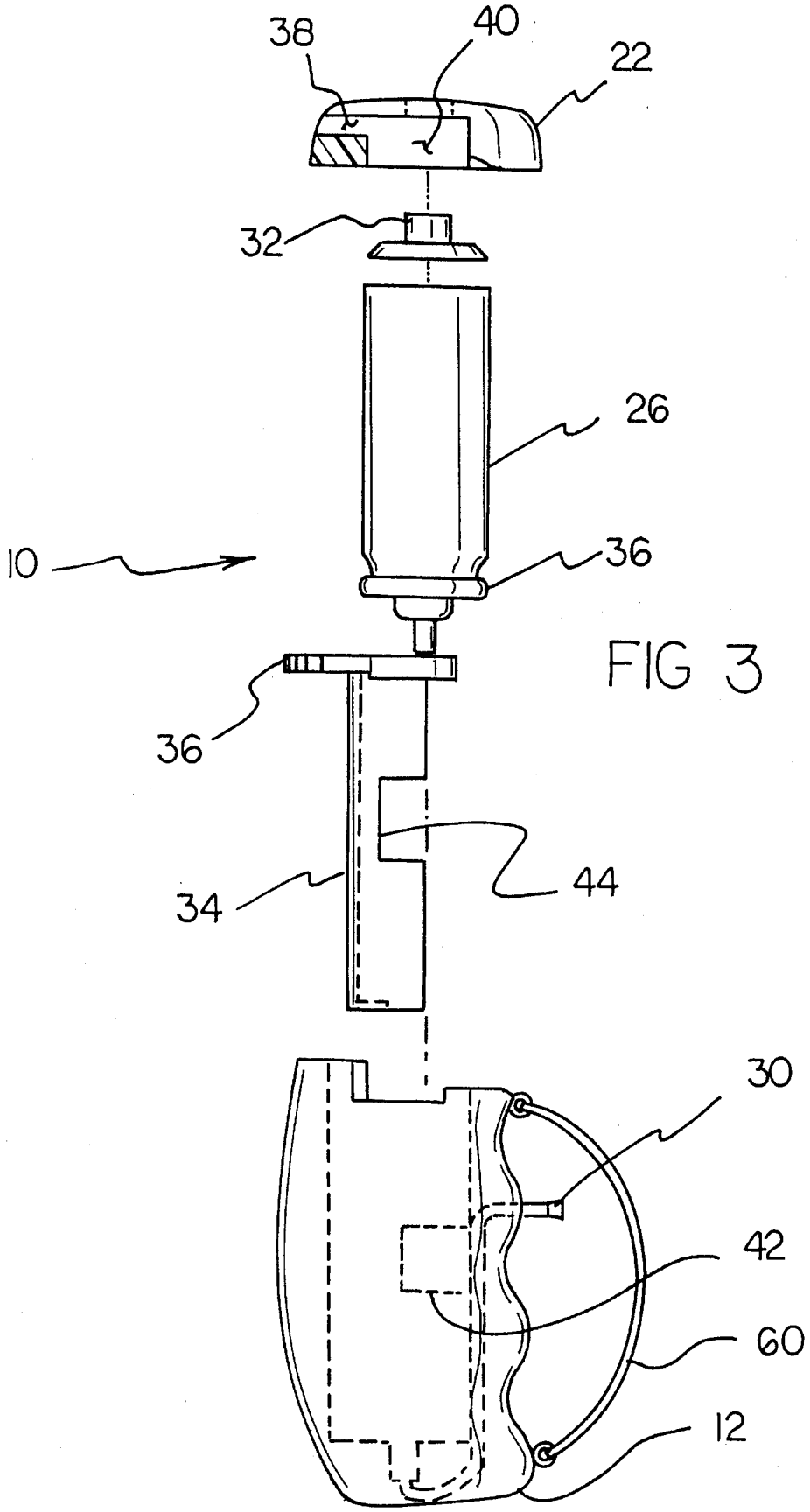
FIG. 3 is an exploded view of the present invention.

As shown in FIGS. 1 through 3, the main body 12 is preferably comprised of a plastic material or the like and includes a plurality of arcuate contours 18 extending along a front end thereof which engage fingers of the hand holding the device 10. The main body 12 is shaped so as to define a hollow interior 20 within which the dispensing means 16 is removably contained. A cap 22 encloses the dispensing means 16 within the hollow interior 20 of the main body 12 and can be selectively removed to facilitate access to the dispensing means for replacement or refilling of the chemical repellant.

With continuing reference to FIGS. 1 through 3, it can be shown that the dispensing means 16 according to the present invention 10 preferably comprises a nozzle receiver 24 formed within the hollow interior 20 of the main body 12 for receiving an unlabeled dispensing nozzle of a gas cylinder 26. A fluid conduit 28 extends from the nozzle receiver 24 and is positioned in fluid communication with the nozzle conduit 14. The gas cylinder 26 is configured such that a depression of the dispensing nozzle will eject a pressurized chemical repellant from the gas cylinder for expulsion through the nozzle conduit 14. The dispensing means 16 further comprises a spray nozzle 30 coupled to a distal end of the nozzle conduit 14 which concentrates the chemical repellant into a directive stream. To effect depression of the dispensing nozzle of the gas cylinder 26, an actuating button 32 extends through an aperture in the cap 22 and into contact with an opposed end of the gas cylinder 26. Thus, a depression of the actuating button 32 will bias the gas cylinder 26 towards the nozzle receiver 24 to effect depression of the dispensing nozzle of the gas cylinder to dispense the chemical repellant therefrom.

To preclude an unintentional dispensing of the chemical repellant from the gas cylinder 26, the dispensing means 16 according to the present invention 10 may additionally comprise a locking means for precluding unintentional movement of the gas cylinder 26 relative to the main body 12. To this end, a lock member 34 extends at least partially about the gas cylinder 26 and engages a flange 36 of the gas cylinder to preclude longitudinal movement of the gas cylinder relative to the lock member. The lock member 34 is dimensioned to fit within the hollow interior 20 in a surrounding relationship relative to the gas cylinder 26, as shown in the cross section illustration of FIG. 2. A projecting lock lever 36 extends orthogonally from the lock member 34 and projects through a pair of slots cooperatively defined by the cap 22 and the main body 12. The slots include a lock slot 38 and an unlock slot 40, as shown in FIG. 3. The lock slot 38 is characterized as having a transverse dimension substantially equal to a transverse dimension of the projecting lock lever 36 such that axial movement of the lock member 34 within the hollow interior 20 of the main body 12 is precluded when the lock lever is positioned within the lock slot 38. In contrast, the unlock slot 40 is characterized as having a transverse slot substantially greater than the transverse dimension of the projecting lock lever 36 such that a rotation of the lock lever into the unlock slot 40 permits axial movement of the lock member 34 within the hollow interior 20 of the main body 12.

To preclude an unintentional dispensing of the chemical repellant from the gas cylinder 26 during installation of the gas cylinder into the hollow interior 20 of the main body 12, a guide member 42 of semi-cylindrical configuration extends along an interior surface of the hollow interior 20 of the main body 12. The guide member 42 is positioned into alignment with a lock member recess 44 formed in the lock member 34. The lock member 34 is similarly constructed in a semi-cylindrical configuration such that insertion of the lock member 34 with the gas cylinder 26 positioned therein ensures that the projecting lock lever 36 is aligned with the lock slot 38. Once the lock member 34 is positioned into the hollow interior 20 such that the lock member recess 44 is aligned with the guide member 42, only then can the lock lever 36 be positioned into the unlock slot 40 to permit axial movement of the lock member 34 and associated gas cylinder 26 to effect dispensing of the chemical repellant therefrom. Thus, the lock recess 44 is of a transverse dimension substantially greater than a transverse dimension of the guide member 42 to permit such axial translation of the lock member 34 within the hollow interior 20 of the main body 12. By this structure, accidental or unintentional dispensing of the chemical repellant from the gas cylinder 26 during installation thereof is substantially precluded.

Figure 4:
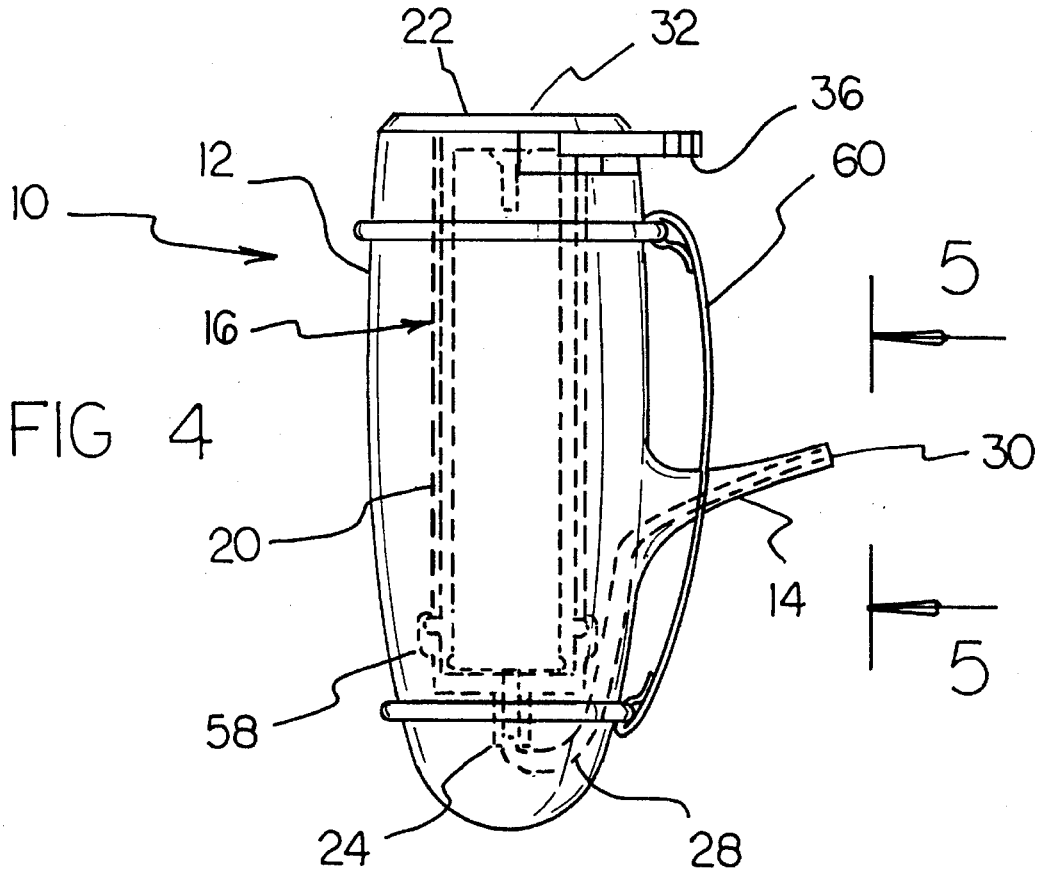
FIG. 4 is a side elevation view of an alternative form of the present invention.
Figure 5:
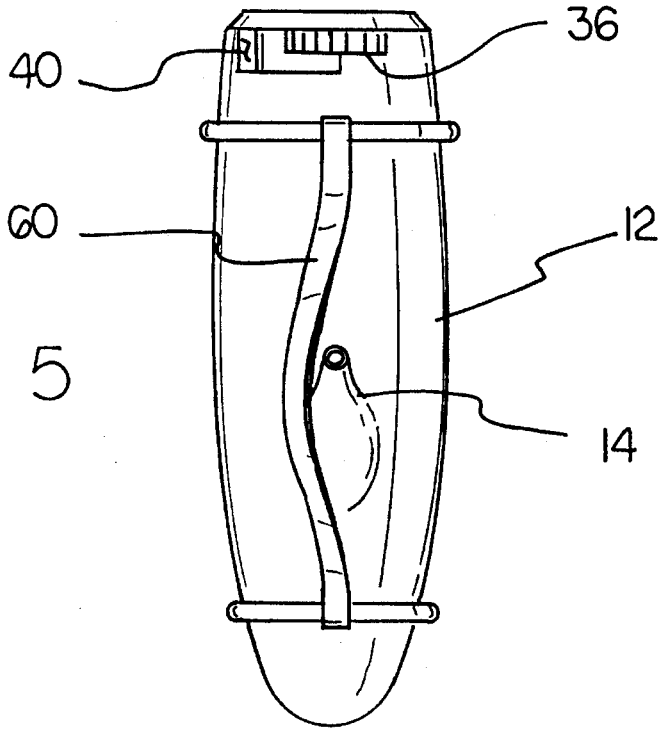
FIG. 5 is a front elevation view of the device as shown in FIG. 4.
Figure 6:
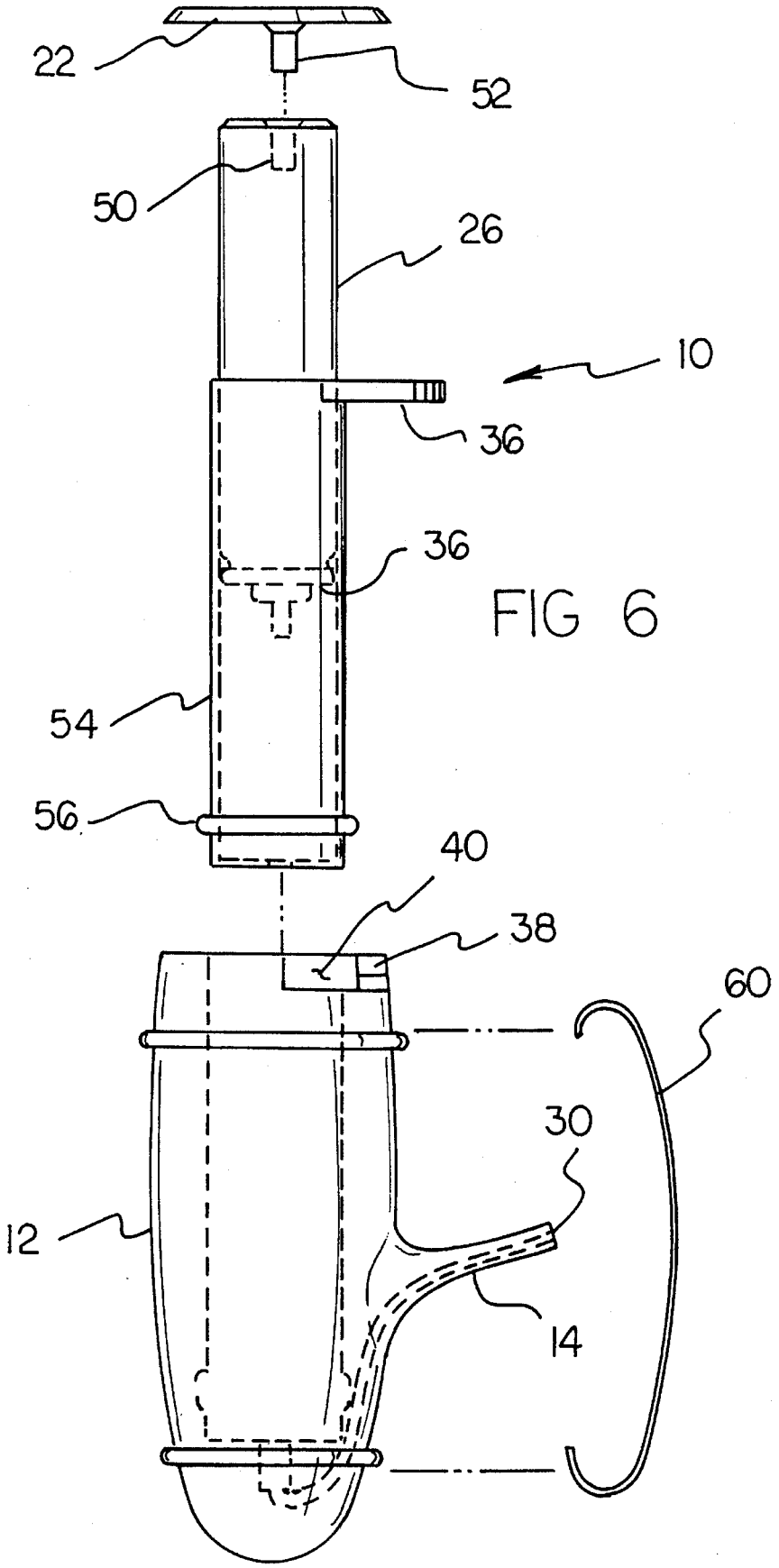
FIG. 6 is an exploded view of the alternative form of the invention.

Turning now to FIGS. 4 through 6, it can be shown that the nozzle conduit 14 may be integrally formed into the main body 12, with the spray nozzle 30 being similarly integrally formed into the nozzle conduit as well. In this alternative form of the present invention 10 illustrated in FIGS. 4 through 6, it can be shown that the dispensing means 16 similarly includes a nozzle receiver 24 which receives the dispensing nozzle of the gas cylinder 26, with the nozzle receiver being in communication with the nozzle conduit through the fluid conduit 28. However, instead of the gas cylinder 26 comprising a sealed replaceable cartridge, as illustrated in FIGS. 1 through 3, the gas cylinder 26 may alternatively comprise a refillable cartridge having a refill port 50 permitting re-pressurization and refilling of a chemical repellant into the gas cylinder 26. In this alternative form of the present invention, the cap 22 is configured to be flexible in nature and includes a descending projection 52 which extends into the refill port 50 close the refill port and to secure the cap 22 relative to the main body 12. Because the cap 22 can be flexed, the flexible cap thus operates as the actuating button 32, whereby a depression of the flexible cap will bias the gas cylinder 26 towards the nozzle receiver 24 to effect dispensing of the chemical repellant therefrom.

The locking means of the alternative form of the present invention includes a cylindrical lock member 54 having an annular projection 56 extending about a lower end thereof. The lock member 54 engages the flange 36 of the gas cylinder 26 to limit axial movement of the gas cylinder relative to the lock member 54. As best shown in FIGS. 4 and 6, the hollow interior 20 of the main body 12 is shaped so as to define an annular cavity 58 which receives the annular projection 56 of the lock member 54 to slidably couple the lock relative to the main body 12. To this end, the annular cavity 58 is of a transverse dimension substantially greater than a transverse dimension of the annular projection 56 to permit such axial movement of the lock member 54 within the hollow interior 20. The lock lever 36 extends from the lock member 54 and can be positioned within either the lock slot 38or the unlock slot 40 as described above.

To facilitate retention of the main body 12 of either form of the present invention 10 relative to the hand of an individual, a strap 60 extends from opposed ends of the main body 12 for extension about the fingers of the hand of the individual utilizing the device 10.

In use, the palm held pepper spray 10 according to the present invention can be concealed within the palm of an individual, whereby an actuation of the dispensing means 16 can be easily accomplished through a rotation of the projection lever 36 into the unlocked slot 40 and a subsequent depression of the actuating button 32. Because the nozzle conduit 14 is configured to project between two fingers of the individual's hand, accidental deflection of the spray of the chemical repellant is substantially eliminated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A palm held pepper sprayer comprising:

a main body means for positioning across a palm of a hand, the main body means comprises a main body shaped so as to define a hollow interior;

a nozzle conduit means projecting from a medial portion of the main body means for positioning between two adjacent fingers of the hand; and, a dispensing means positioned within the hollow interior of the main body means for dispensing a chemical repellant through the nozzle conduit means, the dispensing means comprises a nozzle receiver positioned within the hollow interior of the main body for receiving a dispensing nozzle of a gas cylinder; a fluid conduit extending from the nozzle receiver and positioned in fluid communication with the nozzle conduit; and a spray nozzle means coupled to a distal end of the nozzle conduit for concentrating a chemical repellant into a directive stream.

2. The palm held pepper sprayer of claim 1, and further comprising a cap coupled to the main body for enclosing the dispensing means within the hollow interior of the main body; wherein the dispensing means further comprises an actuating button movably coupled to the cap for engaging an end of a gas cylinder such that a depression of the actuating button will bias the gas cylinder towards the nozzle receiver to effect depression of a dispensing nozzle of the gas cylinder.

3. The palm held pepper sprayer of claim 2, wherein the dispensing means further comprises a locking means for precluding unintentional movement of the gas cylinder relative to the main body.

4. The palm held pepper sprayer of claim 3, wherein the locking means comprises a lock member extendable at least partially about a gas cylinder and engagable to a flange of the gas cylinder to preclude longitudinal movement of the gas cylinder relative to the lock member, the lock member being dimensioned to fit within the hollow interior in a surrounding relationship relative to the gas cylinder; and a projecting lock lever extending orthogonally from the lock member and projecting through a pair of slots formed in the main body, the slots including a lock slot and an unlock slot, with the lock slot having a transverse dimension substantially equal to a transverse dimension of the projecting lock lever such that axial movement of the lock member within the hollow interior of the main body is precluded when the lock lever is positioned within the lock slot, and the unlock slot having a transverse slot substantially greater than the transverse dimension of the projecting lock lever such that a rotation of the lock lever into the unlock slot permits axial movement of the lock member within the hollow interior of the main body.

5. The palm held pepper sprayer of claim 4, wherein the locking means further comprises a guide member of semi-cylindrical configuration extending along an interior surface of the hollow interior of the main body, the guide member being positioned into alignment with a lock member recess formed in the lock member, the lock member being substantially semi-cylindrical in shape such that an insertion of the lock member into the hollow interior of the main body ensures that the projecting lock lever is aligned with the lock slot, wherein the lock member recess is of a transverse dimension substantially greater than a transverse dimension of the guide member to permit an axial translation of the lock member within the hollow interior of the main body when the lock member recess is positioned over the guide member and the lock lever is positioned within the unlock slot.

6. The palm held pepper sprayer of claim 5, wherein the main body includes a plurality of arcuate contours extending along a front end thereof which engage fingers of a hand.

7. The palm held pepper sprayer of claim 3, wherein the hollow interior of the main body is shaped so as to define an annular cavity; and further wherein the locking means comprises a cylindrical lock member having an annular projection extending about a lower end thereof, the lock member being operable to receive a gas cylinder therewithin and engage a flange of the gas cylinder to limit axial movement of the gas cylinder relative to the lock member, the annular cavity of the main body receiving the annular projection of the lock member to slidably couple the lock member relative to the main body, the annular cavity being of a transverse dimension substantially greater than a transverse dimension of the annular projection to permit axial movement of the lock member within the hollow interior; and a projecting lock lever extending orthogonally from the lock member and projecting through a pair of slots formed in the main body, the slots including a lock slot and an unlock slot, with the lock slot having a transverse dimension substantially equal to a transverse dimension of the projecting lock lever such that axial movement of the lock member within the hollow interior of the main body is precluded when the lock lever is positioned within the lock slot, and the unlock slot having a transverse slot substantially greater than the transverse dimension of the projecting lock lever such that a rotation of the lock lever into the unlock slot permits axial movement of the lock member within the hollow interior of the main body.

8. The palm held pepper sprayer of claim 7, wherein the nozzle conduit is integrally formed into the main body, with the spray nozzle being integrally formed into the nozzle conduit.

9. The palm held pepper sprayer of claim 8, and further comprising a gas cylinder having a refill port permitting re-pressurization and refilling of a chemical repellant into the gas cylinder, the gas cylinder being positioned within the lock member.

10. The palm held pepper sprayer of claim 9, wherein the cap is substantially flexible and includes a depending projection which extends into the refill port of the gas cylinder to close the refill port and to secure the cap relative to the main body, wherein a flexing of the cap will bias the gas cylinder towards the nozzle receiver to effect dispensing of a chemical repellant therefrom.

* * * * *